US011207913B2

(12) United States Patent
Banzai et al.

(10) Patent No.: US 11,207,913 B2
(45) Date of Patent: Dec. 28, 2021

(54) ERASING MEMBER AND ERASING TOOL USING THE SAME

(71) Applicant: MITSUBISHI PENCIL COMPANY, LIMITED, Shinagawa-ku (JP)

(72) Inventors: Satoru Banzai, Fujioka (JP); Toshimi Kamitani, Yokohama (JP); Yosuke Setagawa, Fujioka (JP); Hitoshi Kino, Fujioka (JP); Tooru Nakajima, Yokohama (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 367 days.

(21) Appl. No.: 14/088,795

(22) Filed: Nov. 25, 2013

(65) Prior Publication Data

US 2014/0150203 A1 Jun. 5, 2014

(30) Foreign Application Priority Data

Dec. 5, 2012 (JP) ..... JP2012-266167
Mar. 15, 2013 (JP) ..... 2013-053095

(51) Int. Cl.
*B43L 19/00* (2006.01)

(52) U.S. Cl.
CPC ..... *B43L 19/0025* (2013.01); *B43L 19/0075* (2013.01)

(58) Field of Classification Search
CPC ..... B43K 29/02; B43L 19/0025; B43L 19/0075; B43L 19/0093; B43L 19/0056; B43L 19/2068; B43L 19/00–19/0081; B43L 19/02–19/04; B43L 21/00–21/04
USPC ..... 15/424, 427; 401/52
See application file for complete search history.

(56) References Cited

U.S. PATENT DOCUMENTS 4,987,118 A 1/1991 Murata et al.
5,051,279 A 9/1991 Murata et al.
D394,876 S * 6/1998 Chuang ..... D19/187
7,316,841 B1 * 1/2008 Hayashi ..... B43L 19/0025 134/6

(Continued)

FOREIGN PATENT DOCUMENTS

CN 201158245 Y * 12/2008
JP 62-227933 A 10/1987
JP 63-168385 A 7/1988

(Continued)

*Primary Examiner* — Shay Karls
(74) *Attorney, Agent, or Firm* — Buchanan Ingersoll & Rooney PC

(57) ABSTRACT

Provided are an erasing member which is excellent in erasability for handwritings written by means of a pencil, a mechanical pencil and the like and which does not produce eraser dusts, and an erasing tool in which a part to be erased can be visually recognized in erasing.The erasing member comprises a blend composition containing a liquid-absorbing porous material, and a basic magnesium carbonate porous material and the like can be used as the liquid-absorbing porous material. And in an erasing tool in which an erasing part is formed at one end and in which a transparent or translucent visible part making it possible to visually recognize a writing surface is provided in the vicinity of the erasing part, the erasing member described above is mounted to the erasing part, whereby the erasing tool which does not produce eraser dusts is obtained.

6 Claims, 6 Drawing Sheets

(56) References Cited

U.S. PATENT DOCUMENTS

2005/0129606 A1* 6/2005 Mitsuhashi ..... A01N 25/08
423/430

FOREIGN PATENT DOCUMENTS

| | | | | |
|---|---|---|---|---|
| JP | 01-262198 | A | | 10/1989 |
| JP | 02-020399 | A | | 1/1990 |
| JP | H02-147400 | A | | 6/1990 |
| JP | 5-091890 | U | | 12/1993 |
| JP | 3041992 | U | | 10/1997 |
| JP | 2001-096984 | A | | 4/2001 |
| JP | 2005-219397 | A | | 8/2005 |
| JP | 2006-044144 | A | | 2/2006 |
| JP | 2011251432 | A | * | 12/2011 |

* cited by examiner

ERASING MEMBER AND ERASING TOOL USING THE SAME

This Nonprovisional application claims priority under 35 U.S.C. § 119(a) on Patent Applications No. 2012-266167 filed in Japan on 5 Dec. 2012 and No. 2013-053095 filed in Japan on 15 Mar. 2013, the entire contents of which are hereby incorporated by reference.

BACKGROUND OF THE INVENTION

1. Field of the Invention

The present invention relates to an erasing tool used for erasing handwritings and the like written on surfaces of paper by means of writing instruments such as pencils, mechanical pencils, ballpoint pens and felt-tipped pens, more specifically to an erasing member which does not produce eraser dusts and an erasing tool using the same which is excellent in visibility of a part to be erased.

2. Description of the Related Art

Rubber erasers are usually used as an erasing tool for erasing handwritings written by means of pencils, mechanical pencils and the like, and the shapes of the rubber erasers include, as shown in FIG. 2 of patent document 1 and FIG. 1 of patent document 2, a rectangular prism and a polygon. In the case of the rectangular prism, an aperture part is formed in one end of a rubber eraser case of a bottomed box shape and an erasing member is inserted from the aperture part, and a polygon is suited to erasing at a corner. However, the problem that it is hard to observe parts to be erased in erasing handwritings is involved in patent documents 1 and 2.

Rubber materials such as natural rubbers and synthetic rubbers, and plastic materials in which plastics such as polyvinyl chloride are principal components have so far been known as materials for erasing members. Further, erasers prepared by blending base materials with various abrasives, inorganic substances and the like in order to enhance erasability for handwritings and the like have so far been known.

In conventional erasing tools, rubber erasers prepared by blending 100 parts by weight of a styrene base thermoplastic elastomer with 5 to 400 parts by weight of polyisoprene having a weight average molecular weight of 5,000 to 300,000 and 100 to 1,000 parts by weight of a filler are known as rubber erasers which are excellent in erasability and in which a collecting property of eraser dusts produced in erasing are improved so that the eraser dusts are easily disposed (refer to, for example, patent document 3).

However, eraser dusts remain in erasing by the rubber erasers described above, and therefore involved therein are the problems that even eraser dusts having a good collecting property have to be gathered and disposed and that eraser dusts which can not completely be gathered stain floors and the like.

In recent years, studying in a living room is recommended, but eraser dusts on a dining table can not be wiped off with a dishcloth, and they are not preferable in terms of sanitation.

An eraser characterized in that an erasing member comprising a non-abrasive material, to be specific, a spherical or cylindrical erasing member to which abrasion powder of a pencil lead are adhered and which are not worn by abrasion with paper is arranged at a tip of the eraser so that it can be rotated and moved is known as an eraser for solving the above problems (refer to, for example, patent document 4). The blending composition of the above erasing member includes a thermoplastic elastomer blended with liquid paraffin and a vinyl chloride resin blended with a plasticizer and a stabilizer, and therefore the adhesive forces thereof are not sufficiently high.

In the eraser prepared in the above patent document 4, handwritings drawn on a paper surface are erased, as described in the examples, by rotating the spherical or cylindrical erasing member to adhere abrasion powder of a pencil lead on the surface of the erasing member, and therefore if an adhesion area of the erasing member is small, the abrasion powder can not be adhered after repeating an erasing operation several times, which results in rather staining the paper surface. Also, if an adhesion area on the surface of the erasing member is increased, the spherical or cylindrical erasing member is increased as well in a size, and therefore the problem that fine parts can not precisely be erased is brought about.

Accordingly, in patent document 5, the holder is formed by a transparent material so that parts to be erased can be observed in erasing handwritings, whereby the rubber eraser has visual recognition. This makes it easy to find a remaining amount of the erasing member in the holder, but visibility of the handwritings in erasing is not necessarily excellent.

PATENT DOCUMENTS

Patent document 1: Japanese Utility Model Application Laid-Open Hei 5 No. 91890

Patent document 2: Japanese Patent Application Laid-Open No. 2006-44144

Patent document 3: Japanese Patent Application Laid-Open No. 2001-96984

Patent document 4: Japanese Patent Application Laid-Open No. 2005-219397

Patent document 5: Japanese Utility Publication No. 3041992

SUMMARY OF THE INVENTION

In light of the foregoing problems of the prior arts, the present invention intends to solve them, and an object thereof is to provide an erasing member which does not stain a paper surface in erasing handwritings written by a pencil, a mechanical pencil and the like and can surely erase them and which does not produce eraser dusts and an erasing tool using the same which is excellent in visibility of parts to be erased.

In light of the conventional problems described above, intense researches repeated by the present inventors have resulted in finding that an erasing member which does not produce eraser dusts is obtained by using a blend composition containing a specific liquid-absorbing porous material and that an erasing tool which not only does not produce eraser dusts but also can visually recognize with ease parts to be erased in handwritings and the like in erasing is obtained by mounting the erasing member in an erasing tool having a specific structure. Thus, the present invention has come to be completed.

That is, the present invention comprises the following items (1) to (8).

(1) An erasing member comprising a blend composition which contains a liquid-absorbing porous material.

(2) The erasing member as described in the above item (1), wherein the liquid-absorbing porous material comprises particles having a specific surface area of 100 to 500 $m^2/g$ and a liquid-absorbing rate of 100 to 300 ml/100 g.

(3) The erasing member as described in the above item (1) or (2), wherein the liquid-absorbing porous material is a basic magnesium carbonate porous material.

(4) The erasing member as described in the above item (3), wherein the basic magnesium carbonate porous material comprises particles in which flaky fine crystals are aggregated.

(5) The erasing member as described in any one of the above items (1) to (4), wherein a content of the liquid-absorbing porous material is 5 to 40% by mass based on the total amount of the erasing member.

(6) The erasing member as described in any one of the above items (1) to (5), wherein the erasing member further contains a carbon material.

(7) The erasing member as described in any one of the above items (1) to (6), wherein the erasing member further contains fiber particles.

(8) An erasing tool for erasing handwritings written on a writing surface, wherein an erasing part for erasing the handwritings is provided at one end thereof, and a visible part through which the writing surface can visually be recognized is provided in the vicinity of the erasing part; and the erasing member as described in any one of the above items (1) to (7) is mounted to the erasing part.

The handwritings referred to in the present invention include characters, pictures, lines and the like which are written by writing instruments charged with pencil leads, mechanical pencil leads, eraser-erasable inks, thermochromic inks and the like.

Also, the erasure referred to in the present invention means to make handwritings and the like invisible and includes not only adsorption or removal thereof from a writing surface by a rubber eraser but also discoloration or decoloration of thermochromic inks by frictional heat.

Further, the erasing part referred to in the present invention means a part to which the erasing member is mounted to erase handwritings, and the vicinity means that the visible part does not necessarily have to be brought into contact with the erasing part and is in a position where a writing surface can be visually recognized with ease through the visible part in an erasing action.

DETAILED DESCRIPTION OF THE INVENTION

Figure 1A:
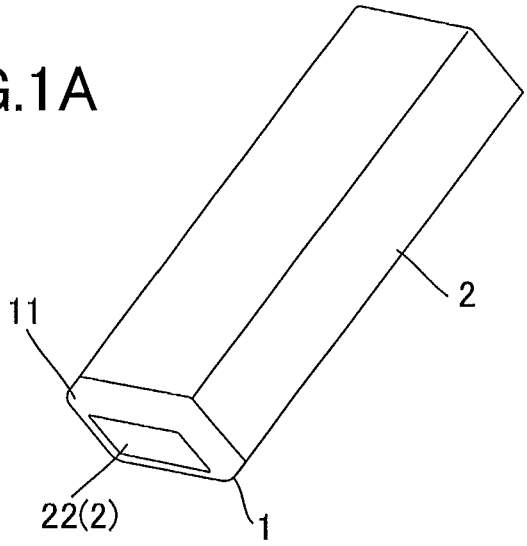
FIG. 1A to FIG. 1F are drawings showing a first embodiment of an erasing tool which enables visual recognition in the present invention.

The embodiments of the present invention shall be explained below in detail.

The erasing member of the present invention is characterized by comprising a blend composition containing a liquid-absorbing porous material.

The liquid-absorbing porous material used in the present invention is composed essentially of a porous material provided with a liquid-absorbing property which has a large specific surface area and a high liquid absorption rate, and it includes a porous material having a specific surface area of 100 to 500 $m^2/g$ and a liquid absorption rate of 100 to 300 ml/100 g. The specific surface area described above is determined by a BET method, and the liquid absorption rate is determined by a minimum amount of linseed oil at which a pile of powder of 100 g is turned to a flowing state from a powder ball state when the linseed oil is dropped onto the pile.

The liquid-absorbing porous material which can specifically be used includes basic magnesium carbonate porous materials, porous cellulose particles, petaloid porous structure composite of calcium carbonate and calcium phosphate, petaloid porous structure composite of calcium phosphate, porous styrene particles, porous acryl particles, porous nylon particles, porous silica particles and the like. The respective liquid-absorbing porous materials which meet the ranges of the specific surface area and the liquid absorption rate each described above are preferably used.

Among the above liquid-absorbing porous materials, the basic magnesium carbonate porous material is preferably used in terms of manufacturing, availability, a cost and the like. The above basic magnesium carbonate porous material is composed of tubular aggregated particles comprising flaky fine crystals, and the above tubular particles have preferably an outer diameter of 1 to 20 μm and a length of 5 to 200 μm.

The basic magnesium carbonate in the present invention is represented by a chemical formula $mMgCO_3.Mg(OH)_2.nH_2O$, wherein the values of m and n shall not specifically be restricted, and the value of m may be 3 to 5, and the value of n may be 3 to 8 as is the case with conventional basic magnesium carbonate. Also, the tubular particles of the basic magnesium carbonate are not particles aggregated in such a form that the flaky fine crystals are readily dispersed by simple stirring and a change in the environment such as temperature and pH, and they are particles obtained by aggregating the flaky fine crystals of the basic magnesium carbonate and physically fixing them.

The basic magnesium carbonate porous materials are produced by known methods, and the tubular particles of the flaky fine crystals comprising the basic magnesium carbonate can be produced by using a water-soluble magnesium salt and a water-soluble carbonate in an aqueous solution.

For example, the respective grades of commercially available MgTube (manufactured by Nittetsu Mining Co., Ltd.) or grades obtained by subjecting the surfaces of the particles thereof to alumina treatment and treatments with various fatty acids and the like can be used as the above basic magnesium carbonate porous materials.

A content of the basic magnesium carbonate porous materials is 5 to 40% by mass (hereinafter, "% by mass" shall be referred to merely as "%"), preferably 7 to 20% based on the total amount of the erasing member composition.

If the content is less than 5%, it results in scarcely obtaining the effects of the present invention that a paper surface is not stained in erasing handwritings and that eraser dusts are not produced. On the other hand, if it exceeds 40%, problems on molding and mixing in the production process are brought about. Accordingly, both are not preferred.

In addition to the liquid-absorbing porous material used in the present invention, the blend composition for an erasing member comprises preferably a base material component, a plasticizer and a filler. Further, it is blended, if necessary, with the prescribed amounts of various compounding ingredients used for rubber erasers and the like to be molded, whereby the erasing member which does not stain a paper surface in erasing handwritings written by a pencil, a mechanical pencil and the like and can surely erase them and which does not produce eraser dusts can be prepared.

The base material component which can be used shall not specifically be restricted, and at least one of, for example, various kinds of thermoplastic resins, synthetic rubbers and the like can be used.

The thermoplastic resins include, for example, vinyl chloride base resins such as vinyl chloride resins, vinyl chloride-vinyl acetate copolymers, acryl base resins such as polymethyl methacrylate, ethylene-vinyl acetate copolymers, ethylene-acrylic acid copolymers, polyolefins, chlorinated polyolefins, and the like. The synthetic rubbers include, for example, butyl rubber, butadiene rubber, nitrile rubber, nitrile-butadiene rubber, styrene-butadiene rubber, and the like. The particularly preferred resins include the vinyl chloride base resins.

The vinyl chloride base resins which are suitably used include, to be specific, Kanevinyl series (manufactured by Kaneka Corporation), VINIKA series (manufactured by Mitsubishi Kasei Vinyl Co., Ltd.), Ryuron Paste series (homopolymers and copolymers, manufactured by Tosoh CORPORATION) and the like as vinyl chloride. These resins may be used alone or in combination of two or more kinds thereof.

A content of the base material components is preferably 20 to 60% based on total amount of the erasing member composition.

The plasticizer which can be used shall not specifically be restricted as long as it can plasticize or gelatinize the thermoplastic resin contained therein. It includes, for example, dioctyl phthalate (DOP), dioctyl adipate (DOA), dioctyl sebacate (DOS), dibutyl sebacate (DBS), dimethyl phthalate (DMP), dihexyl phthalate, and the like. The compounds are contained in an amount of preferably 5 to 40% based on the total amount of the erasing member composition.

The filler which can be used shall not specifically be restricted as long as it is not a material which is dissolved in or reacted with vinyl chloride and the plasticizer. It includes, for example, magnesium carbonate other than the liquid-absorbing porous material described above, calcium carbonate, magnesium oxide, silica, talc, clay, diatomaceous earth, quartz powder, alumina, alumina silicate, mica, sericite, montmorillonite, and the like. The compounds are contained in an amount of preferably 5 to 50% based on the total amount of the erasing member composition.

In particular, the above fillers have preferably an average particle diameter of 10 to 200 nm in terms of the erasability, the strength and the lubricity. The average particle diameter in the present invention (including examples and others which are described later) means an average diameter obtained by weighing a measurement result in a laser•diffraction method with a volume. In a case of, for example, magnesium carbonate, an average particle diameter thereof can be measured by using Microtrac (3100II, manufactured by Nikkiso Co., Ltd.).

A carbon material is preferably contained in the erasing member of the present invention from the viewpoints of further enhancing the erasing power, improving the erasing feeling and inhibiting the deformation, and fiber particles are preferably contained therein from the viewpoints of enhancing the erasing power and inhibiting the deformation.

The carbon material which can be used includes, for example, at least one of carbon black, carbon fibers, graphite, carbon nanofibers, and the like. The compounds are contained in an amount of preferably 1 to 20% based on the total amount of the erasing member composition. The carbon materials having a size (particle size or diameter) of 20 μm or less at most (particle size) are preferably used.

The fiber particles which can be used include, for example, at least one of fiber particles such as polyethylene fibers, cellulose fibers, aramid fibers, vinylon fibers, polyamide fibers, polyester fibers and glass fibers. The fiber particles are contained in an amount of preferably 1 to 20% based on the total amount of the erasing member composition. The fiber particles having a diameter of 20 μm or less at most are preferably used.

Also, for example, a heat-stabilizer such as Ca—Zn stearate can be used, if necessary, in order to prevent the various compounding ingredients such as the base material components (particularly the vinyl chloride base resin) from being thermally degraded at high temperature. Further, a viscosity controlling agent, a lubricant, a solvent, a colorant, a UV absorber, a preservative, an anti-mold agent, a fragrance and the like can be blended in suitable amounts.

Further, when a rubber and an elastomer are used as the base material components, a softening agent, a vulcanizing agent, a vulcanization accelerator, a filler, an antioxidant, a colorant and the like can be blended in suitable amounts.

The erasing member of the present invention can be produced by mixing the blend compositions comprising the liquid-absorbing porous material, the base material components, the plasticizer, the filler, the carbon material and the fiber particles each described above and, if necessary, the foregoing various compounding ingredients respectively in prescribed amounts by means of a conventional method and then molding it into a preferred shape.

Due to the following action and mechanism, the erasing member of the present invention does not stain a paper surface in erasing handwritings written by a pencil, a mechanical pencil and the like to make it possible to surely erase them and does not produce eraser dusts as compared with conventional rubber erasers which produce eraser dusts.

That is, the liquid-absorbing porous material, for example, the basic magnesium carbonate porous material and the like are contained in the blending composition for the erasing member of the present invention, whereby when the erasing member is rubbed against handwritings, graphite is adsorbed on the liquid-absorbing porous material contained in the erasing member and removed from a paper surface; the adsorbed graphite is dispersed into the erasing member and the graphite is continuously adsorbed thereon due to adsorbability of the liquid-absorbing porous material, and eraser dusts are not produced; the graphite once adsorbed are not moved again to the paper surface, and therefore the paper surface is not stained, so that the handwritings can surely be erased. Accordingly, the erasing member of the present invention does not produce eraser dusts and is excellent in erasability to handwritings. In the erasing member of the present invention, graphite and the like absorbed in every erasing are dispersed and accumulated therein. When the erasing member is colored, for example, white, the erasing member is increased in a black degree in every erasing.

Next, the embodiment of the erasing tool which enables visual recognition according to the present invention shall be explained while referring to drawings. Common reference numerals and letters shall be affixed to the corresponding constituents over the whole drawings.

In the present specification, an erasing part side is referred to as "a front", and a side opposite thereto is referred to as "a rear".

Figure 1C:
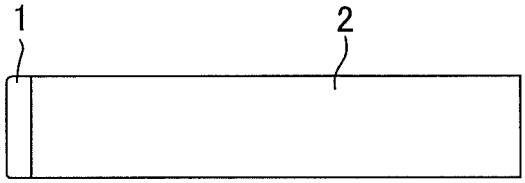
Figure 1B:
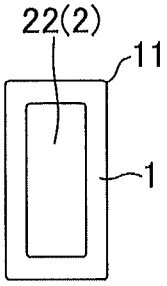
Figure 1D:
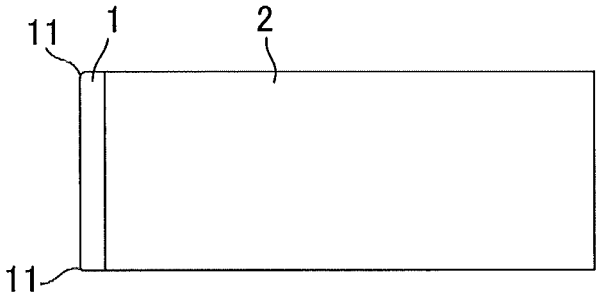
Figure 1F:
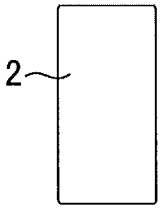
Figure 1E:
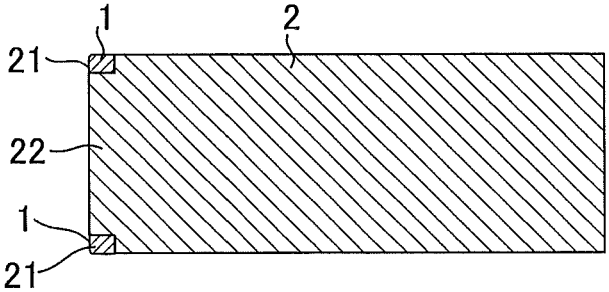

FIG. 1A to FIG. 1F are drawings showing a first embodiment of the erasing tool which enables visual recognition in the present invention. FIG. 1A is a perspective drawing observed from a front of FIG. 1D; FIG. 1B is a left side drawing of FIG. 1D; FIG. 1C is a plane drawing; FIG. 1D is a front drawing; FIG. 1E is a vertical cross-sectional drawing of FIG. 1D; and FIG. 1F is a right side drawing of FIG. 1D.

The first embodiment comprises an erasing part 1 which is a rubber eraser and a visible part 2 which enables visual recognition of a writing surface in an erasing action. The erasing part 1 at the front has a rectangular external form. A curved surface part 11 is formed on a periphery of the erasing part 1. The visible part 2 is inserted as a core material into a center of the erasing part 1.

The erasing part 1 is fixed on a surface of a step part 21 formed on a periphery of a convex part 22 formed at a tip part of the visible part 2. The erasing part 1 and the visible part 2 are integrated by press fitting, fusing, adhering or the like and preferably can not be detached in an erasing action.

A writing surface having thereon handwritings can be visually recognized through the visible part 2 in an erasing action, and therefore the handwritings and the like can be erased while observing a part to be erased.

Next, the visible part 2 shall be explained in detail. The visible part 2 is formed by transparent or translucent synthetic resins such as polycarbonate and ABS resins, and transparent materials such as glass, and they may be materials which make it possible to visually recognize a writing surface through the visible part 2.

The visible part 2 is formed by a harder material than that of the erasing part 1, whereby it becomes easy to erase handwritings by applying force in an erasing action to make it possible to erase even handwritings which get into an inner part of the fibers of the paper surface. Also, the visible part 2 can be set as the core material of the erasing part 1, and therefore the erasing part 1 can be less liable to be broken in an erasing action. Further, since it is not necessary to use a paper case and the like, a form of a holding part can be optional, and transfer printing and the like can easily be made onto a surface thereof so that the design property is enhanced.

Figure 2A:
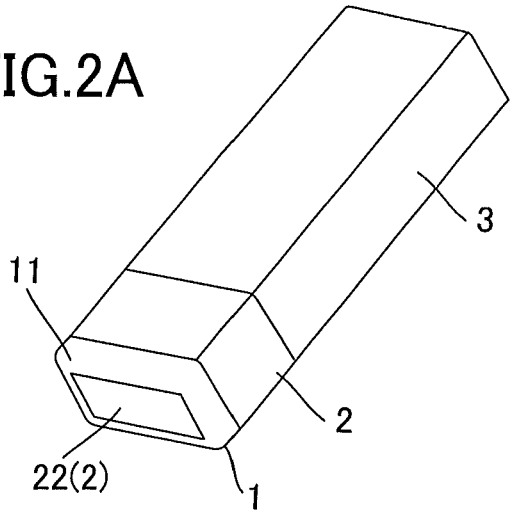
FIG. 2A to FIG. 2G are drawings showing a second embodiment of an erasing tool which enables visual recognition in the present invention.
Figure 2C:
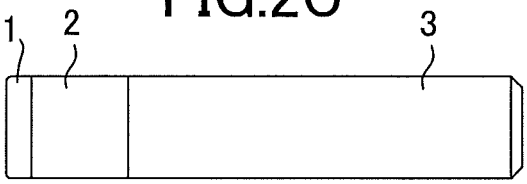
Figure 2D:
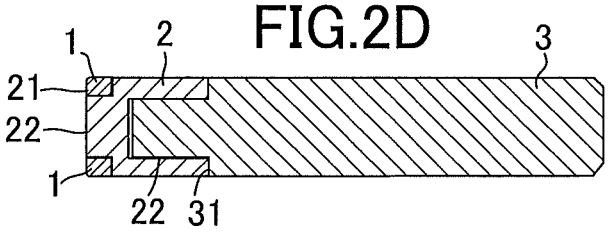
Figure 2B:
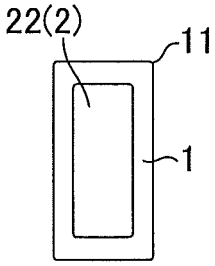
Figure 2E:
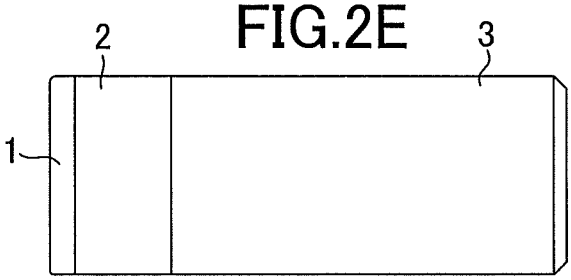
Figure 2G:
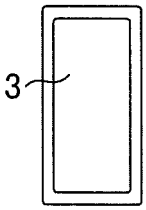
Figure 2F:
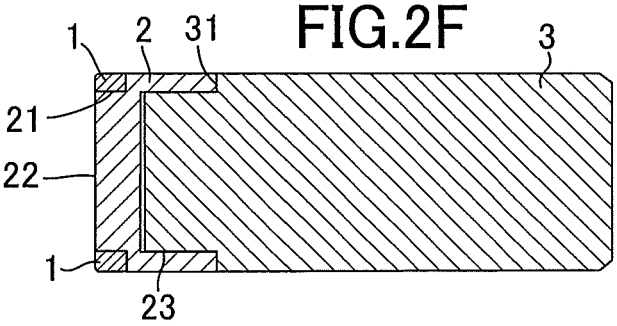

FIG. 2A to FIG. 2G are drawings showing a second embodiment of the erasing tool which enables visual recognition in the present invention. FIG. 2A is a perspective drawing observed from a front of FIG. 2E; FIG. 2B is a left side drawing of FIG. 2E; FIG. 2C is a plane drawing; FIG. 2D is a vertical cross-sectional drawing of FIG. 2C; FIG. 2E is a front drawing; FIG. 2F is a vertical cross-sectional drawing of FIG. 2E; and FIG. 2G is a right side drawing of FIG. 2E.

A point which is different from the first embodiment is that a holding part 3 is provided and that the visible part 2 is detachable from the holding part 3. The embodiment in which the visible part 2 is detachable from the holding part 3 makes it easy to replace the erasing part 1 when it is abraded or stained with a colorant and the like.

The visible part 2 and the holding part 3 are fitted in an fitting part 23 and brought into contact at a contact part 31. The visible part 2 and the holding part 3 are fitted by a pressure fitting method in the present embodiment, but the fixing method does not matter and may be a method for fixing them by a screw, a method for fixing them with concavity and convexity, and the like.

Also, the holding part 3 is rectangular prism in the present embodiment but may have an easy-to-grip form.

Figure 3B:
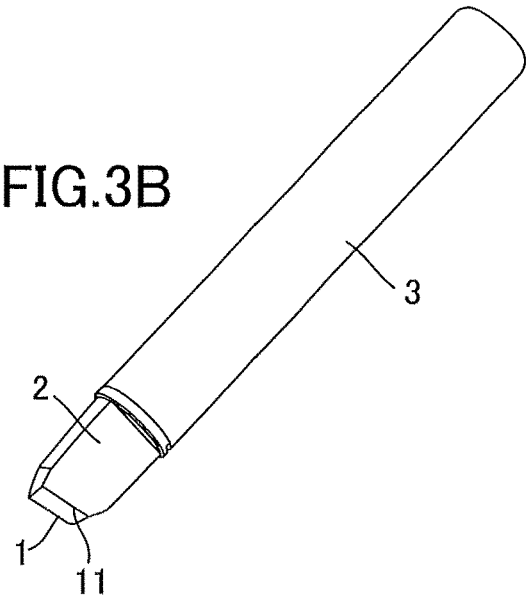
FIG. 3A to FIG. 3E are drawings showing a third embodiment of an erasing tool which enables visual recognition in the present invention.
Figure 3A:
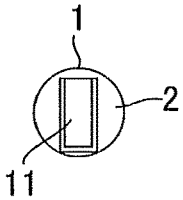
Figure 3C:
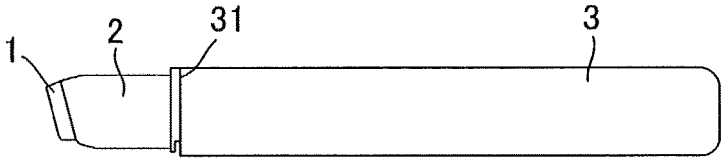
Figure 3E:
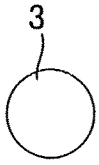
Figure 3D:
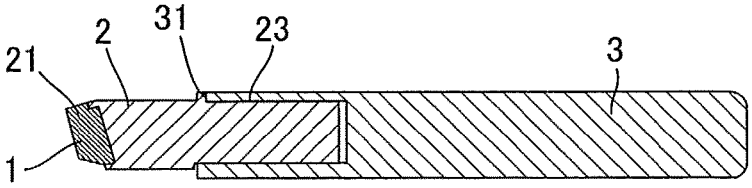

FIG. 3A to FIG. 3E are drawings showing a third embodiment of the erasing tool which enables visual recognition in the present invention. FIG. 3A is a left side drawing of FIG. 3C; FIG. 3B is a perspective drawing observed from a front of FIG. 3C; FIG. 3C is a front drawing; FIG. 3D is a vertical cross-sectional drawing of FIG. 3C; and FIG. 3E is a right side drawing of FIG. 3C.

The third embodiment shows an erasing tool of a pen type, and an erasing part 1 has a curved surface part 11 formed thereon and is provided with a slender chisel form. In erasing, an erasing action is carried out by gripping a holding part 3. The erasing part 1 has a slender form which is similar to a mark box in a mark sheet test and therefore is suited to erasing a marked portion which has been erroneously coated with a black color.

In a visible part 2, a step part 21 is formed at a front thereof, and the erasing part 1 is fixed thereon. Also, an fitting part 23 for fitting to the holding part 3 is formed at a rear thereof. The visible part 2 and the holding part 3 are configured so that when they are brought into contact at a contact part 31, they are fitted in an fitting part 23 and are not detached in an erasing action.

The visible part 2 and the holding part 3 can firmly be fitted by fusing, adhering and the like.

Figure 4B:
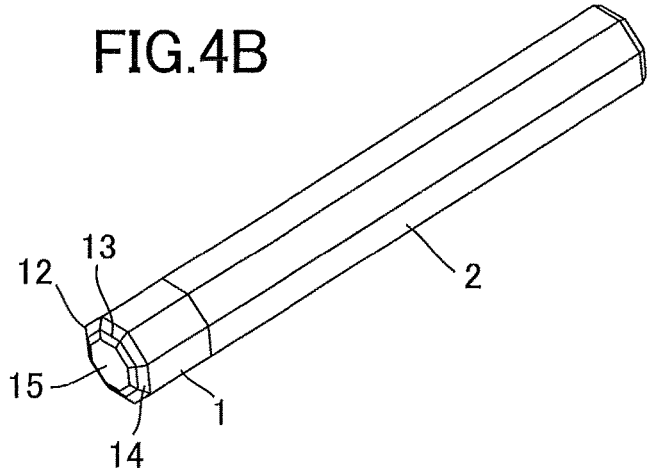
FIG. 4A to FIG. 4E are drawings showing a fourth embodiment of an erasing tool which enables visual recognition in the present invention.
Figure 4A:
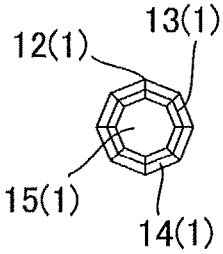
Figure 4C:
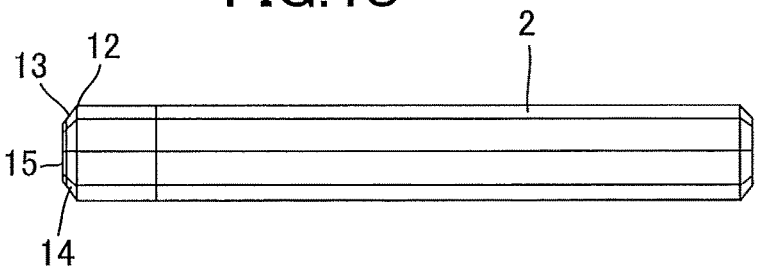
Figure 4E:
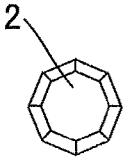
Figure 4D:
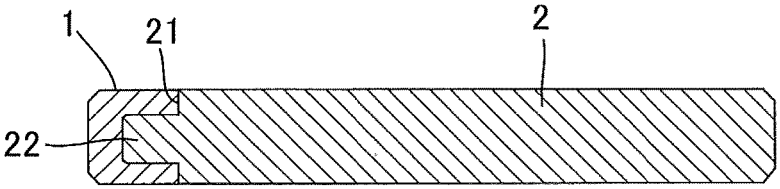

FIG. 4A to FIG. 4E are drawings showing a fourth embodiment of the erasing tool which enables visual recognition in the present invention. FIG. 4A is a left side drawing of FIG. 4C; FIG. 4B is a perspective drawing observed from a front of FIG. 4C; FIG. 4C is a front drawing; FIG. 4D is a vertical cross-sectional drawing of FIG. 4C; and FIG. 4E is a right side drawing of FIG. 4C.

The fourth embodiment shows an erasing tool of a bar type, wherein an erasing part 1 is provided at a front, and a visible part 2 integrated with a holding part is configured at a rear. The erasing part 1 is formed in the form of an octagon observed from a diameter direction, and an apex part 12, a line part 13, a face part 14 and a plane part 15 are provided thereon. Any of the apex part 12, the line part 13, the face part 14 and the plane part 15 can can contact with a writing face according to an erasing angle so that a contact area of the erasing part with the writing face varies, and therefore an erasing range can readily be selected to make it possible to efficiently carry out an erasing work.

The erasing part 1 is fixed on a step part 21 and on the periphery of a convex part 22 which are formed at a front of the visible part 2. The erasing part 1 and the visible part 2 are preferably fixed by adhesion or fusion so that they are not detached in an erasing action. The visible part 2 is formed by a harder material than the erasing part 1, and the erasing part 1 can be less liable to be broken in the erasing action by forming the convex part 22 as a core member.

Figure 5B:
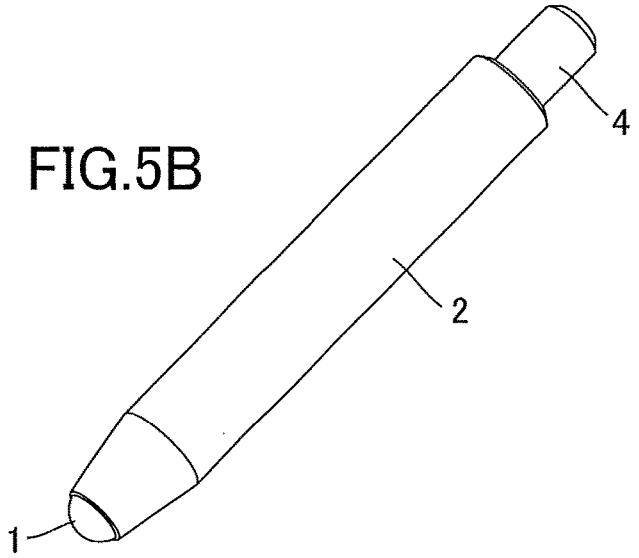
FIG. 5A to FIG. 5E are drawings showing a fifth embodiment of an erasing tool which enables visual recognition in the present invention.
Figure 5A:
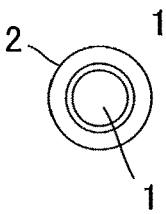
Figure 5C:
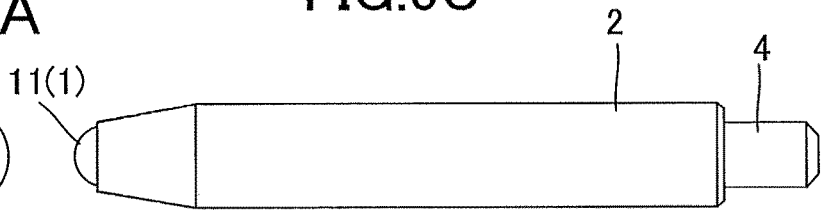
Figure 5E:
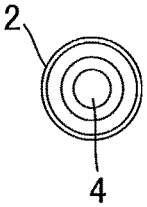
Figure 5D:
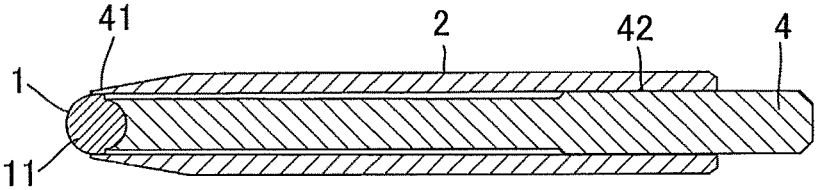

FIG. 5A to FIG. 5E are drawings showing a fifth embodiment of the erasing tool which enables visual recognition in the present invention. FIG. 5A is a left side drawing of FIG. 5C; FIG. 5B is a perspective drawing observed from a front of FIG. 5C; FIG. 5C is a front drawing; FIG. 5D is a vertical cross-sectional drawing of FIG. 5C; and FIG. 5E is a right side drawing of FIG. 5C.

The fifth embodiment shows an erasing tool of a ballpoint pen type. A part of a spherical erasing part 1 having a curved surface part 11 is protruded toward a front of a visible part 2. The erasing part 1 which is spherical is less liable to be broken in an erasing action. Also, in the case that the erasing part 1 is rotatable, it is possible to turn an erasing surface to a fresh one by rotating the erasing part 1 when the erasing part 1 is flattened by abrasion or colorants such as pencil leads and inks of writing instruments are adhered thereon.

A supporting part 4 presses the erasing part 1 from a rear toward a front in order to prevent the erasing part 1 from dropping out from the visible part 2. A receiving seat 41 is formed at a front of the supporting part 4 to make it possible to stably hold the spherical erasing part 1. Also, a connecting part 42 which is press-fitted into the visible part 2 are formed at the rear so that the supporting part 4 is not readily detached from the visible part 2. The connecting part 42 may be connected by a screw so that the erasing part 1 is readily exchanged. The material of the supporting part 4 is preferably transparent or translucent in order to visually recognize a writing surface in an erasing action, and it may be the same material as that of the visible part 2.

Figure 6A:
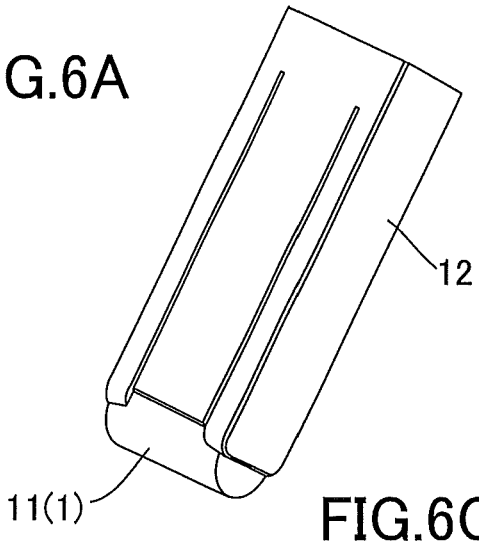
FIG. 6A to FIG. 6G are drawings showing a sixth embodiment of an erasing tool which enables visual recognition in the present invention.
Figure 6C:
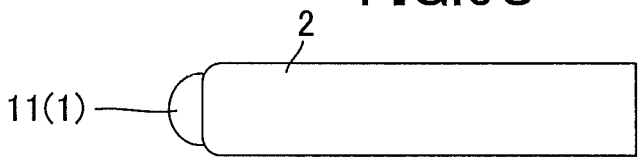
Figure 6D:
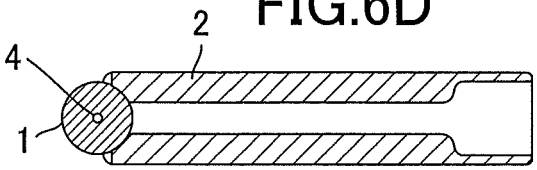
Figure 6B:
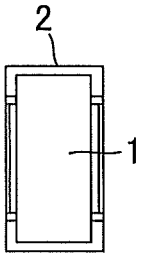
Figure 6E:
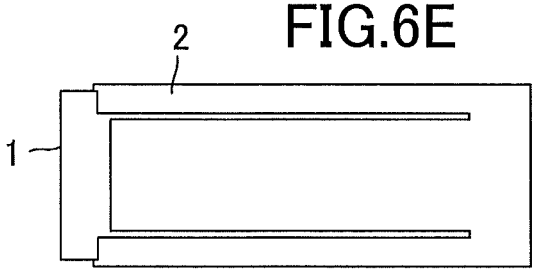
Figure 6G:
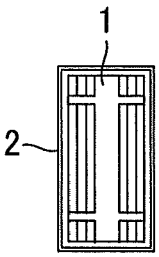
Figure 6F:
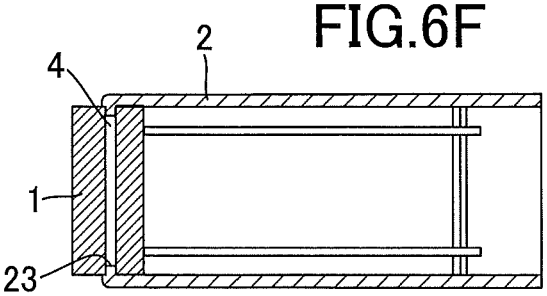

FIG. 6A to FIG. 6G are drawings showing a sixth embodiment of the erasing tool which enables visual recognition in the present invention. FIG. 6A is a perspective drawing observed from a front of FIG. 6E; FIG. 6B is a left side drawing of FIG. 6E; FIG. 6C is a plane drawing; FIG. 6D is a vertical cross-sectional drawing of FIG. 6C; FIG. 6E is a front drawing; FIG. 6F is a vertical cross-sectional drawing of FIG. 6E; and FIG. 6G is a right side drawing of FIG. 6E.

The sixth embodiment shows an erasing tool in which an erasing part 1 is formed in a cylindrical form and supported by a supporting part 4 which is a roller. The roller is not rotated in an erasing action by friction with a writing surface of a paper and the like, whereby it is possible to carry out erasing by the erasing part, and the erasing part 1 can be rotated to be turned an erasing surface to a fresh one when colorants such as pencil leads and inks of writing instruments are adhered thereon.

The supporting part 4 is mounted in a central part of the erasing part 1 in FIG. 6F. Also, both ends of the supporting part 4 are fitted in fitting parts 23 which are bent to an inside at a front of a visible part 2.

The shape of the erasing part includes, for example, a bar, a rectangular prism, a cylinder, a triangular pyramid, a quadrangular pyramid, a fan form and the like. Further, it includes a penholder shape and a tape shape.

According to the present invention, provided is an erasing member which does not stain a paper surface in erasing handwritings written by a pencil, a mechanical pencil and the like and does not produce eraser dusts and an erasing tool which makes it possible to visually find parts to be erased with ease since a writing surface having thereon handwritings can be visually recognized through the visible part, so that parts to be erased can surely be erased.

EXAMPLES

The erasing member of the present invention shall be explained in further details with reference to examples and comparative examples, but the present invention shall not be restricted to the following examples.

Examples 1 to 7 and Comparative Examples 1 to 3

Example 1

| | |
|---|---|
| MgTube (liquid-absorbing porous material, particles in which flaky fine crystals of basic magnesium carbonate are aggregated in a tubular form, outer diameter: 3.5 μm, length: 20 μm, inner diameter: 1 μm, specific surface area: 150 m2/g, liquid absorption rate: 300 ml/100 g, manufactured by Nittetsu Mining Co., Ltd.) | 10% by mass |
| Polyvinyl chloride (Kaneka Kanevinyl PSM-154, manufactured by Kaneka Corporation) | 30% by mass |
| Ca—Zn stearate (stabilizer) | 1% by mass |
| Dioctyl phthalate (plasticizer) | 59% by mass |

The blending materials described above were mixed by means of a vacuum mixer to prepare a blend composition (paste). The composition was poured into a mold and molded by heating at 150° C. for 1 hour while applying a pressure at 1 kg/cm$^2$ to obtain an erasing member, and the erasing member thus obtained was mounted to an erasing tool shown in FIG. 2.

Example 2

An erasing member was obtained in the same manner as in Example 1, except that a blending amount of MgTube in Example 1 was changed to 5% by mass and that a blending amount of polyvinyl chloride was changed to 35% by mass, and the erasing member thus obtained was mounted to the erasing tool shown in FIG. 2.

Example 3

An erasing member was obtained in the same manner as in Example 1, except that a blending amount of MgTube in Example 1 was changed to 40% by mass, that a blending amount of polyvinyl chloride was changed to 20% by mass and that a blending amount of dioctyl phthalate was changed to 39% by mass, and the erasing member thus obtained was mounted to the erasing tool shown in FIG. 2.

Example 4

| | |
|---|---|
| MgTube in Example 1 | 10% by mass |
| Calcium carbonate (NEOLIGHT SS: average particle diameter 40 nm, manufactured by Takehara Kagaku Kogyo Co., Ltd.) | 10% by mass |
| Polyvinyl chloride (Kanevinyl PSM-154, manufactured by Kaneka Corporation) | 30% by mass |
| Ca—Zn stearate (stabilizer) | 1% by mass |
| Dioctyl phthalate (plasticizer) | 49% by mass |

The blending materials described above were mixed by means of a vacuum mixer to prepare a blend composition (paste). The composition was poured into a mold and molded by heating at 150° C. for 1 hour while applying a pressure at 1 kg/cm$^2$ to obtain an erasing member, and the erasing member thus obtained was mounted to the erasing tool shown in FIG. 2.

Example 5

| | |
|---|---|
| MgTube in Example 1 | 15% by mass |
| Carbon fibers (PYROFIL: milled fiber, Φ7 μm, length 1000 μm, manufactured by Mitsubishi Rayon Co., Ltd.) | 10% by mass |
| Polyvinyl chloride (Kanevinyl PSM-154, manufactured by Kaneka Corporation) | 20% by mass |
| Ca—Zn stearate (stabilizer) | 1% by mass |
| Dioctyl phthalate (plasticizer) | 54% by mass |

The blending materials described above were mixed by means of a vacuum mixer to prepare a blend composition (paste). The composition was poured into a mold and molded by heating at 150° C. for 1 hour while applying a pressure at 1 kg/cm$^2$ to obtain an erasing member, and the erasing member thus obtained was mounted to the erasing tool shown in FIG. 2.

Example 6

| | |
|---|---|
| MgTube in Example 1 | 15% by mass |
| Glass fibers (glass fiber, Φ12 μm, length 3000 μm, manufactured by Nitto Boseki Co., Ltd.) | 10% by mass |
| Polyvinyl chloride (Kanevinyl PSM-154, manufactured by Kaneka Corporation) | 20% by mass |
| Ca—Zn stearate (stabilizer) | 1% by mass |
| Dioctyl phthalate (plasticizer) | 54% by mass |

The blending materials described above were mixed by means of a vacuum mixer to prepare a blend composition (paste). The composition was poured into a mold and molded by heating at 150° C. for 1 hour while applying a pressure at 1 kg/cm$^2$ to obtain an erasing member, and the erasing member thus obtained was mounted to the erasing tool shown in FIG. 2.

Example 7

| | |
|---|---|
| MgTube in Example 1 | 15% by mass |
| Polyamide fibers (nylon, Φ10 μm, length 1000 μm, manufactured by Toray Industries, Inc.) | 10% by mass |
| Polyvinyl chloride (Kanevinyl PSM-154, manufactured by Kaneka Corporation) | 20% by mass |
| Ca—Zn stearate (stabilizer) | 1% by mass |
| Dioctyl phthalate (plasticizer) | 54% by mass |

The materials blending described above were mixed by means of a vacuum mixer to prepare a blend composition (paste). The composition was poured into a mold and molded by heating at 150° C. for 1 hour while applying a pressure at 1 kg/cm$^2$ to obtain an erasing member, and the erasing member thus obtained was mounted to the erasing tool shown in FIG. 2.

Comparative Example 1

| | |
|---|---|
| Calcium carbonate (NS #2300, average particle diameter 1 μm, manufactured by Nitto Funka Kogyo K.K.) | 40% by mass |
| Polyvinyl chloride (Kanevinyl PSM-15, manufactured by Kaneka Corporation) | 40% by mass |

-continued

| | |
|---|---|
| Ca—Zn stearate (stabilizer) | 1% by mass |
| Dioctyl phthalate (plasticizer) | 19% by mass |

The blending materials described above were mixed by means of a vacuum mixer to prepare a blend composition (paste). The composition was poured into a mold and molded by heating at 150° C. for 1 hour while applying a pressure at 1 kg/cm$^2$ to obtain an erasing member, and the erasing member thus obtained was mounted to the erasing tool shown in FIG. 2.

Comparative Example 2

| | |
|---|---|
| Calcium carbonate (NEOLIGHT SS: average particle diameter 40 nm, manufactured by Takehara Kagaku Kogyo Co., Ltd.) | 40% by mass |
| Polyvinyl chloride (Kanevinyl PSM-154, manufactured by Kaneka Corporation) | 40% by mass |
| Ca—Zn stearate (stabilizer) | 1% by mass |
| Dioctyl phthalate (plasticizer) | 19% by mass |

The blending materials described above were mixed by means of a vacuum mixer to prepare a blend composition (paste). The composition was poured into a mold and molded by heating at 150° C. for 1 hour while applying a pressure at 1 kg/cm$^2$ to obtain an erasing member, and the erasing member thus obtained was mounted to the erasing tool shown in FIG. 2.

Comparative Example 3

| | |
|---|---|
| Glass fibers for FRTP(cut length: 3 mm) | 40% by mass |
| Polyvinyl chloride (Kanevinyl PSM-154, manufactured by Kaneka Corporation) | 40% by mass |
| Ca—Zn stearate (stabilizer) | 1% by mass |
| Dioctyl phthalate (plasticizer) | 19% by mass |

The blending materials described above were mixed by means of a vacuum mixer to prepare a blend composition (paste). The composition was poured into a mold having a thickness of 20 mm and molded by heating at 150° C. for 1 hour while applying a pressure at 1 kg/cm$^2$ to obtain an erasing member (20×45×10 mm), and it was used as an erasing tool.

The erasing members obtained in Examples 1 to 7 and Comparative Examples 1 to 2 were mounted to the erasing tool shown in FIG. 2, but it goes without saying that they can be mounted to the erasing tool shown in the other drawings by molding the blend compositions into erasing members having shapes which can be mounted to the respective erasing tools.

The erasing members obtained in Examples 1 to 7 and Comparative Examples 1 to 3 were used to evaluate an erasing rate, a weight change and the production of eraser dusts according to the following respective evaluation methods. The results thereof are shown in the following Table 1.

Evaluation Method of Erasing Rate:

Based on an erasing ability (erasing rate) test for a plastic eraser disclosed in JIS S 6050-2008, the erasing rate (five reciprocations) was measured according to E (erasing rate:=(1−M/C)×100, wherein M is a density of a part to be erased, and C is a density of a colored part).

Evaluation Methods of a Weight Change and the Production of Eraser Dusts:

Measured was a change in a weight of the erasing member before and after the erasing rate measuring test described above. When a change in the weight is a plus value, it shows an adsorbed amount. On the other hand, when a change in the weight is a minus value, it shows an amount of eraser dusts.

Also, the production of the eraser dusts was confirmed by visually observing the eraser dusts in evaluating the erasing rate described above.

TABLE 1

| | Erasing rate (%) | Weight change (mg) | Production of eraser dusts |
|---|---|---|---|
| Example 1 | 97.6 | 0.1 | None |
| Example 2 | 98.0 | 0.2 | None |
| Example 3 | 98.5 | 0.1 | None |
| Example 4 | 98.2 | 0.3 | None |
| Example 5 | 96.8 | 0.3 | None |
| Example 6 | 98.1 | 0.3 | None |
| Example 7 | 95.9 | 0.2 | None |
| Comparative Example 1 | 95.3 | −15 | Produced |
| Comparative Example 2 | 93.5 | −17 | Produced |
| Comparative Example 3 | 95.9 | −20 | Produced |

As apparent from the results shown in Table 1 described above, it has been found that the erasing members prepared in Examples 1 to 7 falling in the scope of the present invention are excellent in erasability for handwritings of pencils and the like and do not produce eraser dusts as compared with the erasing members prepared in Comparative Examples 1 to 3 falling outside the scope of the present invention, and in addition, it has become clear that since the erasing tools using the erasing members can visually recognize writing surface in erasing, parts to be erased can surely be erased. In Comparative Examples 1 to 3, eraser dusts were produced. In addition thereto, parts to be erased could not be visually recognized in the erasing tool prepared in Comparative Example 3.

INDUSTRIAL APPLICABILITY

The erasing members of the present invention can suitably be used for erasing handwritings of pencils, mechanical pencils and the like.

LIST OF REFERENCE NUMERALS AND LETTERS

1 Erasing part
2 Visual part
3 Holding part
4 Supporting part
11 Curved surface part
12 Apex part
13 Line part
14 Face part
15 Plane part
21 Step part
22 Convex part
23 Fitting part
31 Contact part
41 Receiving seat
42 Connecting part

What is claimed is:

1. An erasing member comprising a blend composition which contains a base material component, a plasticizer selected from the group consisting of dioctyl phthalate, dioctyl adipate, dioctyl sebacate, dibutyl sebacate, dimethyl phthalate and dihexyl phthalate, and a basic magnesium carbonate porous material comprising tubular particles in which flaky fine crystals are aggregated such that graphite is adsorbed on the basic magnesium carbonate porous material and dispersed into the erasing member, wherein when the erasing member is used to erase handwriting from paper, the erasing member does not produce eraser dust.

2. The erasing member as described in claim 1, wherein the basic magnesium carbonate porous material comprises particles having a specific surface area of 100 to 500 $m^2/g$ and a liquid absorption rate of 100 to 300 ml/100 g.

3. The erasing member as described in claim 1, wherein a content of the basic magnesium carbonate porous material is 5 to 40% by mass based on the total amount of the erasing member.

4. The erasing member as described claim 1, wherein the erasing member further contains a carbon material.

5. The erasing member as described in claim 1, wherein the erasing member further contains fiber particles.

6. An erasing tool for erasing handwritings written on a writing surface, wherein the erasing tool does not produce eraser dust, and wherein an erasing part for erasing the handwritings is provided at one end thereof, and a visible part through which the writing surface can visually be recognized is provided contiguously with the erasing part; and the erasing member as described in claim 1 is mounted to the erasing part.

* * * * *